US006974198B2

(12) United States Patent
Usuda

(10) Patent No.: US 6,974,198 B2
(45) **Date of Patent: *Dec. 13, 2005**

(54) DRIVE DEVICE OF LIQUID DROPLET DISCHARGE HEAD, FILM MANUFACTURING APPARATUS, DRIVE METHOD OF LIQUID DROPLET DISCHARGE HEAD, FILM MANUFACTURING METHOD, AND ELECTRONIC EQUIPMENT AND DEVICE PRODUCTION METHOD

(75) Inventor: Hidenori Usuda, Matsumoto (JP)

(73) Assignee: Seiko Epson Corporation, (JP)

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 75 days.

(21) Appl. No.: 10/628,883

(22) Filed: Jul. 28, 2003

(65) Prior Publication Data

US 2004/0212645 A1 Oct. 28, 2004

(30) Foreign Application Priority Data

Jul. 31, 2002 (JP) ..... 2002-223153
Mar. 17, 2003 (JP) ..... 2003-072336

(51) Int. Cl.[7] ..... B41J 29/38
(52) U.S. Cl. ..... 347/10; 347/11
(58) Field of Search ..... 347/10, 11, 68, 347/57

(56) References Cited

U.S. PATENT DOCUMENTS 4,072,958 A * 2/1978 Hayami et al. ..... 347/10
4,563,689 A * 1/1986 Murakami et al. ..... 347/11
5,593,757 A * 1/1997 Kashiwazaki et al. ... 428/195.1

FOREIGN PATENT DOCUMENTS

| | | |
|---|---|---|
| JP | 10-204350 | 8/1998 |
| JP | 10-226066 | 8/1998 |
| JP | 11-028819 | 2/1999 |
| JP | 2000-193922 | 7/2000 |
| JP | 2001-080072 | 3/2001 |
| JP | 2002-036535 | 2/2002 |
| JP | 2002-055222 | 2/2002 |
| JP | 2002-134878 | 5/2002 |
| JP | 2002-178508 | 6/2002 |

OTHER PUBLICATIONS

Kobayashi et al., "A novel RGB multicolor light-emitting polymer display", 2000, SyntheticMetals 111-112 (2000) 125-128.*
Communication from Korean Patent Office re: counterpart application.

* cited by examiner

*Primary Examiner*—Thinh Nguyen
(74) *Attorney, Agent, or Firm*—Harness, Dickey & Pierce, P.L.C.

(57) ABSTRACT

This drive device of a liquid droplet discharge head inhibits deterioration of a piezoelectric vibrator, enabling stable liquid droplets to be discharged from the liquid droplet discharge head over a long period of time. This drive device of a liquid droplet discharge head is provided with a piezoelectric vibrator 20 that extends and retracts according to a predetermined drive waveform, a drive control circuit 10 that functions as a drive control unit, and a drive wave generation circuit 30. The drive control circuit 10 drives the piezoelectric vibrator 20 by generating a drive waveform that is free of sharp edges and composed of a curved waveform based on a waveform generated by the drive waveform generation circuit 30.

15 Claims, 13 Drawing Sheets

DRIVE DEVICE OF LIQUID DROPLET DISCHARGE HEAD, FILM MANUFACTURING APPARATUS, DRIVE METHOD OF LIQUID DROPLET DISCHARGE HEAD, FILM MANUFACTURING METHOD, AND ELECTRONIC EQUIPMENT AND DEVICE PRODUCTION METHOD

BACKGROUND OF THE INVENTION

1. Field of the Invention

The present invention relates to a drive device of a vibrator drive type of liquid droplet discharge head, which discharges liquid droplets from a discharge section by extending and retracting a piezoelectric vibrator, a film manufacturing device, a drive method of a liquid droplet discharge head, a film manufacturing method, and an electronic equipment and an device production method.

Priority is claimed on Japanese Patent Application No. 2002-223153 and Japanese Patent Application No. 2003-072336, the contents of which are incorporated herein by reference.

2. Description of Related Art

Vibrator drive type liquid droplet discharge heads, which discharge liquid droplets by extending and retracting a piezoelectric vibrator, are used in liquid droplet discharge devices referred to as ink jet printers used in liquid crystal display panel production devices and printing devices of computer terminal. Piezoelectric vibrators are composed of components that include a piezoelectric element, and are extended and retracted according to an input drive waveform (for example, a voltage waveform).

In a drive device of a liquid droplet discharge head composed in this manner, the piezoelectric vibrator is driven by a voltage waveform composed of a trapezoidal wave as shown in FIG. 15. For example, potential Vcom in FIG. 15 is a predetermined applied voltage value of the piezoelectric vibrator, potential VH is a voltage value at which the piezoelectric vibrator is maximally retracted relative to the direction of liquid droplet discharge, while VL is a voltage value at which the piezoelectric vibrator is maximally extended relative to the direction of liquid droplet discharge. In the case of a layered piezoelectric element, the piezoelectric vibrator maximally retracts relative to the direction of liquid droplet discharge when the applied voltage has reached potential VH, and as a result of the applied voltage reaching potential VL, it is released from that retraction and extended, causing it to be displaced in the direction of liquid droplet discharge by inertia beyond displacement 0 of a so-called stationary state. The liquid droplet discharge device discharges liquid droplets by this extension and retraction operation of a piezoelectric vibrator.

Here, an explanation is provided of the operations of a piezoelectric vibrator respectively corresponding to times T1 through T5 of the voltage waveform shown in FIG. 15. At time T1, the applied voltage to the piezoelectric vibrator is increased from potential Vcom to potential VH. Thus, at time T1, the amounts of extension and retraction of the piezoelectric vibrator increase. At time T2, since a constant potential VH is applied to the piezoelectric vibrator, the piezoelectric vibrator attempts to reach a constant (maximum) amount of extension and retraction. At time T3, since the applied voltage decreases from potential VH to potential VL, the amounts of extension and retraction of the piezoelectric vibrator decrease. At time T4, since a constant potential VL is applied, the piezoelectric vibrator attempts to reach a constant (minimum) amount of extension and retraction. At time T5, since the applied voltage increases from potential VL to potential Vcom, the amounts of extension and retraction of the piezoelectric vibrator increase. As a result of these times T1 through T5 being repeated, the piezoelectric vibrator extends and retracts to discharge liquid droplets from the liquid droplet discharge head of a liquid droplet discharge device.

However, since the piezoelectric vibrator repeats the mechanical operations of extension and retraction, the element itself becomes fatigued and deteriorates. Due to increases in the thermal load that results from sudden extension and retraction as well as increases in the mechanical load resulting from sudden changes in operation from the extension and retraction to the stopped state, deterioration of the element is thought to be accelerated, thereby shortening its service life.

However, in a drive device of a liquid droplet discharge head according to the previously described prior art, as shown in FIG. 15, since the piezoelectric vibrator is driven by the voltage waveform of a trapezoidal wave, the operating state of the piezoelectric vibrator changes suddenly at each transition point A0 through A5 of the waveform. Thus, as previously mentioned, the mechanical and thermal loads on the piezoelectric vibrator increase, thereby resulting in the problems of accelerated deterioration of the element and prevention of discharge of stable liquid droplets from the liquid droplet discharge head for a long period of time.

In consideration of the aforementioned problems, an object of the present invention is to provide a drive device of a liquid droplet discharge head, a film manufacturing apparatus, a drive method of a liquid droplet discharge head, a film manufacturing method, and an electronic equipment and device production method that enable the operation of discharging stable liquid droplets to be performed over a long period of time by inhibiting deterioration of the piezoelectric vibrator.

SUMMARY OF THE INVENTION

In order to achieve the aforementioned object, the drive device of a liquid droplet discharge head of the present invention is provided with a drive control unit that has a piezoelectric vibrator and discharges liquid droplets from a discharge section by applying a predetermined drive waveform to the piezoelectric vibrator; wherein, a drive control unit is provided that drives the piezoelectric vibrator according to the drive waveform composed of a curved shape.

According to this drive device of a liquid droplet discharge head, since the drive control unit drives the piezoelectric vibrator with a drive waveform composed of a curved shape, the extension and retraction operations of the piezoelectric vibrator are made to be more gradual due to the curved drive waveform, thereby inhibiting increases in the mechanical and thermal loads.

As a result, deterioration of the piezoelectric vibrator can be reduced and its service life can be prolonged. As a result, stable droplets can be discharged from the liquid droplet discharge head for a long period of time.

Said drive waveform is preferably a waveform that is free of sharp edges.

According to this drive device of a liquid droplet discharge head, since the piezoelectric vibrator is driven by a drive waveform free of sudden transition points caused by sharp edges in the drive waveform, changes in the operating state of the piezoelectric vibrator are more gradual, thereby inhibiting increases in the mechanical and thermal loads.

Furthermore, a sharp edge refers to, for example, transition points A0 through A5 in the voltage waveform of FIG. 2 where the voltage applied to the piezoelectric vibrator changes suddenly.

If a waveform free of sharp edges is used for the drive waveform in this manner, since the piezoelectric vibrator is driven according to a drive waveform that is free of sudden transition points, changes in the operating state of the piezoelectric vibrator are more gradual, thereby making it possible to more effectively inhibit increases in the mechanical and thermal loads. Thus, stable liquid droplets can be discharged from the liquid droplet discharge head for a long period of time.

Said drive waveform is preferably a waveform that is generated by being converted from a rectangular or trapezoidal square wave by a waveform conversion unit.

According to this drive device of a liquid droplet discharge head, since the drive waveform is generated based on a rectangular or trapezoidal square wave, a drive waveform composed of a curved waveform can be inexpensively generated by using a square waveform generated with an existing drive device.

If the drive waveform is made to be generated based on a rectangular or trapezoidal square waveform in this manner, a drive waveform composed of a curved waveform can be generated inexpensively using a square waveform generated with an existing drive device. Thus, a drive device of a liquid droplet discharge head can be provided inexpensively that is capable of discharging stable liquid droplets from a liquid droplet discharge head for a long period of time by using an existing drive device.

In addition, said drive waveform preferably contains a discharge waveform for discharging said liquid droplets, and a microvibration waveform that minutely vibrates said piezoelectric vibrator to a degree that it does not said discharge liquid droplets.

According to this drive device of a liquid droplet discharge head, in addition to the discharge waveform during discharge of liquid droplets, a microvibration waveform that minutely vibrates the piezoelectric vibrator can also be made to have a curved waveform in order to prevent unstable discharge and clogging of the nozzle hole caused by drying of a functional liquid. As a result, the mechanical load along with the accompanying thermal load can be reduced and deterioration of the piezoelectric vibrator can be inhibited, thereby making it possible to prolong the service life of the piezoelectric vibrator.

In addition, a film manufacturing apparatus for achieving the aforementioned object is provided with said drive device of a liquid droplet discharge head, and performs film manufacturing treatment at a predetermined location on a treated object by discharging a functional liquid from said liquid droplet discharge head.

According to this film manufacturing apparatus, since the film manufacturing apparatus is provided with a liquid droplet discharge head that is composed by using a piezoelectric vibrator having low mechanical and thermal loads, stable droplets can be discharged over a long period of time.

This film manufacturing apparatus is preferably a device that produces a color filter.

According to this film manufacturing apparatus, since a film manufacturing apparatus capable of discharging stable liquid droplets over a long period of time is applied to the production of color filters, high-quality color filters can be produced inexpensively that are composed of a film in which film thickness, flatness, formed location and so forth are more precisely controlled than in the prior art.

This film manufacturing apparatus is preferably a device that forms a film having for its constituent element an organic electroluminescence element.

According to this film manufacturing apparatus, since a film manufacturing apparatus capable of discharging stable liquid droplets over a long period of time is applied to the production of an organic electroluminescence (EL) element, high-quality organic EL elements (devices) can be produced inexpensively that are composed of a film in which film thickness, flatness, formed location and so forth are more precisely controlled than in the prior art.

This film manufacturing apparatus is preferably a device that discharges a liquid containing metallic fine particles from said liquid droplet discharge head, and which forms a film to serve as metal wiring by discharging said liquid onto a desired surface.

According to this film manufacturing apparatus, since a film manufacturing apparatus capable of discharging stable liquid droplets over a long period of time is applied to the production of a film to serve as metal wiring, metal wiring composed of a film in which film thickness, flatness, formed location and so forth are more precisely controlled than in the prior art, namely metal wiring having a low probability of disconnection and which can be arranged at high density, can be produced inexpensively.

In addition, a drive method of a liquid droplet discharge head for achieving the aforementioned object is a drive method of a liquid droplet discharge head comprising the discharge of liquid droplets from a discharge section by extending and retracting a piezoelectric vibrator according to a predetermined drive waveform, wherein the method has processing by which said piezoelectric vibrator is driven according to a drive waveform composed of a curved waveform.

According to this drive method of a liquid droplet discharge head, since the piezoelectric vibrator is driven according to a drive waveform composed of a curved waveform, the extending and retracting operations of the piezoelectric vibrator according to a curved drive waveform are more gradual, thereby inhibiting increases in the mechanical and thermal loads.

As a result, deterioration of the piezoelectric vibrator can be reduced and the service life can be prolonged. Thus, by using this drive method of a liquid droplet discharge head, the effect can be demonstrated in which stable liquid droplets can be discharged from a liquid droplet discharge head for a long period of time.

Said drive waveform is preferable a waveform that is free of sharp edges.

According to this drive method of a liquid droplet discharge head, since the piezoelectric vibrator is driven by a drive waveform that is free of sudden transition points caused by sharp edges, changes in the operating state of the piezoelectric vibrator are more gradual, thereby inhibiting increases in the mechanical and thermal loads.

In this manner, if the drive waveform is made to be a waveform free of sharp edges, since the piezoelectric vibrator is driven according to a drive waveform free of sharp transition points, changes in the operating state of the piezoelectric vibrator are more gradual, thereby making it possible to more effectively inhibit increases in the mechanical and thermal loads. Thus, by using this drive method of a liquid droplet discharge head, the effect can be demonstrated in which stable liquid droplets can be discharged from a liquid droplet discharge head over a long period of time.

Said drive waveform is preferably a waveform generated based on a rectangular or trapezoidal square wave.

According to this drive method of a liquid droplet discharge head, since the drive waveform is generated based on a rectangular or trapezoidal square wave, a drive waveform composed of a curved waveform can be generated inexpensively by using a square wave generated by a conventional drive method.

In this manner, if the drive waveform is made to be generated based on a rectangular or trapezoidal square wave, a drive waveform composed of a curved waveform can be generated inexpensively by using a square wave generated with an existing drive device. Thus, a drive method of a liquid droplet discharge head capable of discharging stable liquid droplets from a liquid droplet discharge head over a long period of time can be provided inexpensively by using an existing drive device.

Said drive waveform preferably contains a discharge waveform for discharging said liquid droplets, and a microvibration waveform that minutely vibrates said piezoelectric vibrator to a degree that it does not discharge said liquid droplets.

According to this drive method of a liquid droplet discharge head, in addition to the discharge waveform during discharge of liquid droplets, a microvibration waveform that minutely vibrates the piezoelectric vibrator can also be made to have a curved waveform in order to prevent unstable discharge and clogging of the nozzle hole caused by drying of a functional liquid. As a result, the mechanical load along with the accompanying thermal load can be reduced and deterioration of the piezoelectric vibrator can be inhibited, thereby making it possible to prolong the service life of the piezoelectric vibrator.

In addition, a film manufacturing method for achieving the aforementioned object forms a film using said drive method of a liquid droplet discharge head.

According to this film manufacturing method, since a film is deposited using a drive method in which there are low mechanical and thermal loads applied to the piezoelectric vibrator of the liquid droplet discharge head, a film can be deposited by discharging stable liquid droplets over a long period of time, and high-quality films can be deposited over a long period of time.

This film manufacturing method is preferably used when forming a film to serve as a constituent element of a color filter.

According to this film manufacturing method, since color filters can be produced using a film manufacturing method capable of forming a stable film over a long period of time, high-quality color filters can be produced inexpensively that are composed of a film in which film thickness, flatness, formed location and so forth are more precisely controlled than in the prior art.

This film manufacturing method is preferably used when forming a film serving as constituent element of an organic electroluminescence element.

According to this film manufacturing method, since organic EL elements can be produced using a film manufacturing method capable of forming a stable film over a long period of time, high-quality organic EL elements can be produced inexpensively that are composed of a film in which film thickness, flatness, formed location and so forth are more precisely controlled than in the prior art.

This film manufacturing method preferably forms a film to serve as metal wiring by discharging a liquid containing metallic fine particles from said liquid droplet discharge head onto a desired surface.

According to this film manufacturing method, since a film to serve as metal wiring can be produced using a film manufacturing method capable of forming a stable film over a long period of time, metal wiring composed of a film in which film thickness, flatness, formed location and so forth are more precisely controlled than in the prior art, namely metal wiring having a low probability of disconnection and which can be arranged at high density, can be produced inexpensively.

In addition, electronic equipment for achieving the aforementioned object is provided with a device produced using said film manufacturing method.

According to this electronic equipment, since electronic equipment can be provided that is composed of a film in which film thickness, flatness, formed location and so forth are more precisely controlled than in the prior art, electronic equipment can be provided rapidly and at low cost that are equipped with electronic devices or optical devices and so forth for which the probability of a malfunction is lower than in the prior art, functions are more advanced and mounting density is higher.

In addition, a device production method for achieving the aforementioned object is a device production method for producing a device by coating a functional liquid at a predetermined location on a substrate, wherein a step is contained in which the functional liquid is discharged at a predetermined location of the substrate from said liquid droplet discharge head using said drive method of a liquid droplet discharge head.

According to this device production method, since a device can be produced that is composed of a film in which film thickness, flatness, formed location and so forth are more precisely controlled than in the prior art, a device for which there is a lower probability of malfunction that in the prior art, functions are more advanced and mounting density is higher, can be provided rapidly and at low cost.

DETAILED DESCRIPTION OF THE INVENTION

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

The following provides an explanation of an embodiment of the present invention with reference to the drawings.

Figure 1:
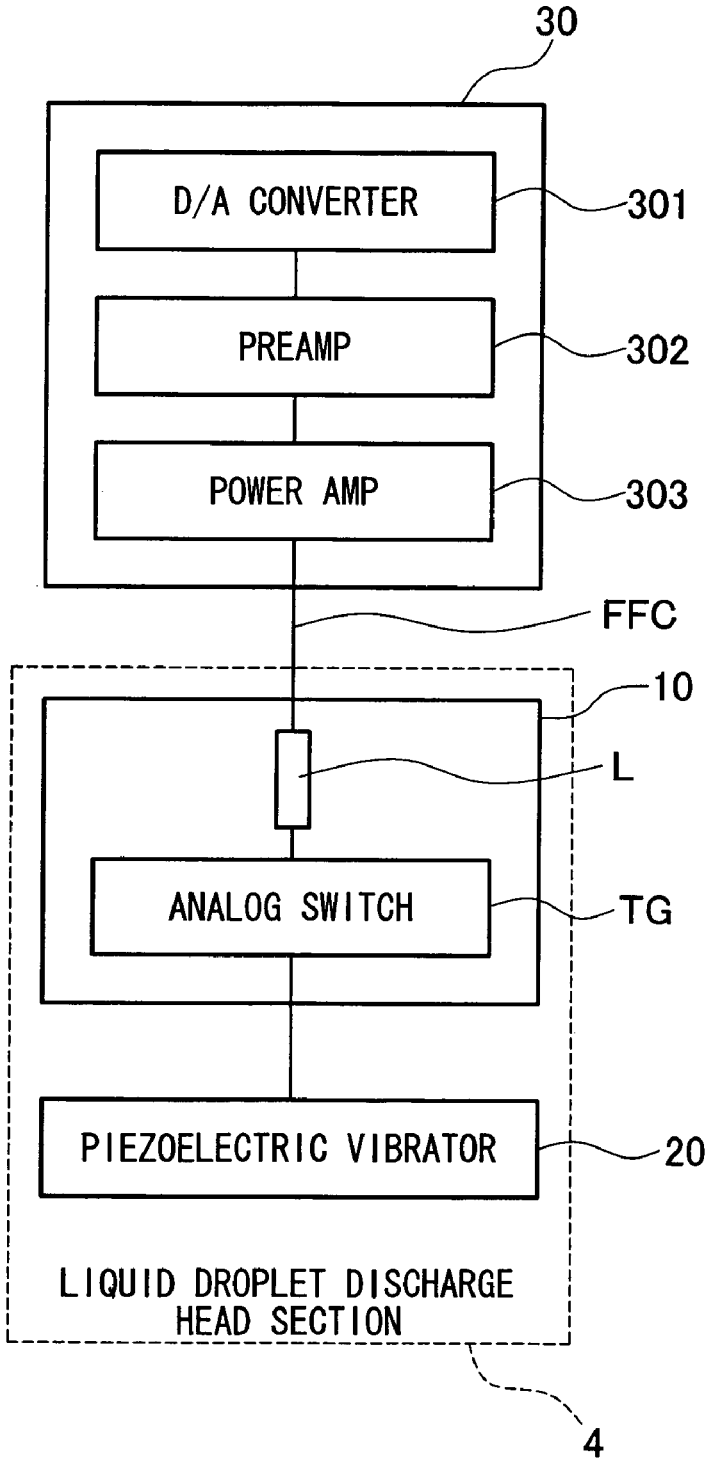
FIG. 1 is a block diagram showing the constitution of a circuit configuration of a drive device of a liquid droplet discharge head according to one embodiment of the present invention.

FIG. 1 is a block diagram showing the circuit configuration of a drive device of a liquid droplet discharge head according to the present embodiment. As shown in this drawing, the drive device of a liquid droplet discharge head according to the present embodiment is composed of a drive control unit in the form of drive control circuit 10, a piezoelectric vibrator 20 that extends and retracts according to a drive waveform supplied from drive control circuit 10, and which is composed of piezo elements and so forth that cause liquid droplets to be discharged from a discharge section of the liquid droplet discharge head, and a drive waveform generation circuit 30 that generates a conventional drive waveform in the form of a trapezoidal square wave.

Furthermore, although drive waveform generation circuit 30 is composed of D/A converter 301, preamp 302 and power amp 303, since these can be composed in the same manner as a drive waveform generation circuit of the prior art, their detailed explanations are omitted. The drive waveform generated with this drive waveform generation circuit 30 is supplied to drive control circuit 10. In addition, drive control circuit 10 and piezoelectric vibrator 20 are provided on the side of liquid droplet discharge head 4 equipped with a discharge section. On the other hand, drive waveform generation circuit 30 is provided on the side of the liquid droplet discharge device (film manufacturing apparatus) main unit that uses a liquid droplet discharge head according to the present embodiment. Drive control circuit 10 and drive waveform generation circuit 30 are connected by, for example, a flexible flat cable (FFC). The output of power amp 303 is sent to drive control circuit 10 through this FFC.

Here, the drive waveform applied to piezoelectric vibrator 20 provided in liquid droplet discharge head section 4 from drive waveform generation circuit 30 through the FFC is broadly divided into a discharge waveform for discharging liquid droplets from liquid droplet discharge head section 4, and a microvibration waveform for minutely vibrating piezoelectric vibrator 20. The aforementioned discharge waveform is a waveform for which the maximum potential, minimum potential and waveform shape for discharging a predetermined amount of liquid droplets are defined. On the other hand, the microvibration waveform is a waveform minutely vibrating the liquid surface (meniscus) of discharged liquid (functional liquid) in nozzle holes by minutely vibrating piezoelectric vibrator 20 to the degree to which liquid droplets are not discharged from liquid droplet discharge head section 4 in order to prevent unstable discharge and clogging caused by drying of the discharge liquid in the nozzle holes of liquid droplet discharge head section 4.

Furthermore, the microvibration waveform is classified into the following four types corresponding to the timing at which the waveforms are applied to piezoelectric vibrator 20. In other words, the four types consist of a constant microvibration waveform that constantly minutely vibrates piezoelectric vibrator 20 while the power of the liquid droplet discharge device is on, a pre-discharge microvibration waveform that minute vibrates piezoelectric vibrator 20 before liquid droplet discharge, a mid-microvibration waveform that minutely vibrates piezoelectric vibrator 20 while discharge of liquid droplets is in progress, and a post-discharge microvibration waveform that minutely vibrates piezoelectric vibrator 20 after liquid droplet discharge. Whether the discharge waveform or the microvibration waveform is applied to liquid droplet discharge head section 4 is selected by analog switch TG.

In the present embodiment, drive control circuit 10 is composed of an inductor L, which is mainly the inductor component of the FCC and is connected in series with the output of drive waveform generation circuit 30 as a waveform conversion unit, and analog switch TG, which drives piezoelectric vibrator 20 according to a drive waveform input through inductor L.

Figure 2:
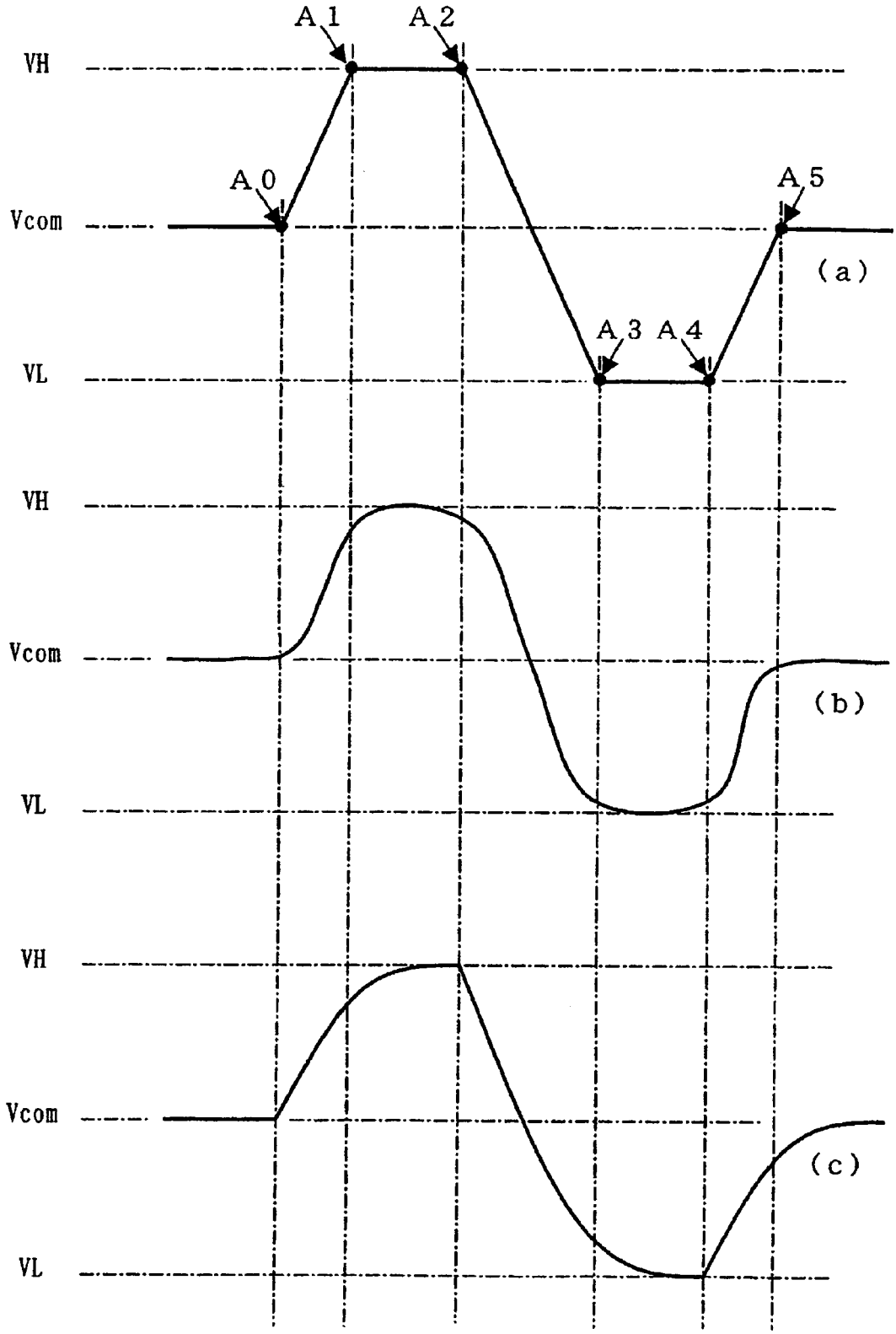
FIG. 2 is a drawing showing a drive waveform of a piezoelectric vibrator according to the present embodiment.

As a result, in the drive device of a liquid droplet discharge head according to the present embodiment, the trapezoidal square wave (a) generated by drive waveform generation circuit 30 is applied between the terminals of piezoelectric vibrator 20 in the form of drive waveform (b) composed of a curved waveform as shown in FIG. 2 by a low-pass LC filter composed by piezoelectric vibrator 20 represented as capacitor C equivalent to inductor L. In addition, transition points A0 through A5 in the trapezoidal square wave are eliminated, and change according to a smooth curve. Namely, the sharp edges (transition points A0 through A5 in square wave (a)), which are transition points at which the voltage applied to piezoelectric vibrator 20 changes suddenly, are eliminated in drive waveform (b).

In piezoelectric vibrator 20, which is driven by a curved waveform in this manner, the mechanical load and its accompanying thermal load are diminished in comparison with the case of being driven by a trapezoidal square wave, thereby inhibiting deterioration of piezoelectric vibrator 20 and prolonging its service life. Thus, stable liquid droplets can be discharged from liquid droplet discharge head section 4 over a long period of time. In addition, the values of inductor L and resistor R preferably use values that have been optimized corresponding to equivalent capacitor C in piezoelectric vibrator 20 and the frequency of the drive waveform.

Figure 3A:
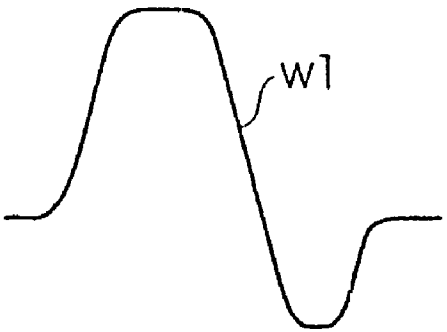
FIGS. 3A through 3C are drawings showing an example of a drive waveform and microvibration waveform that approximate a curved waveform.
Figure 3B:
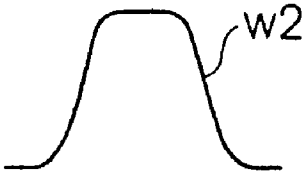
Figure 3C:
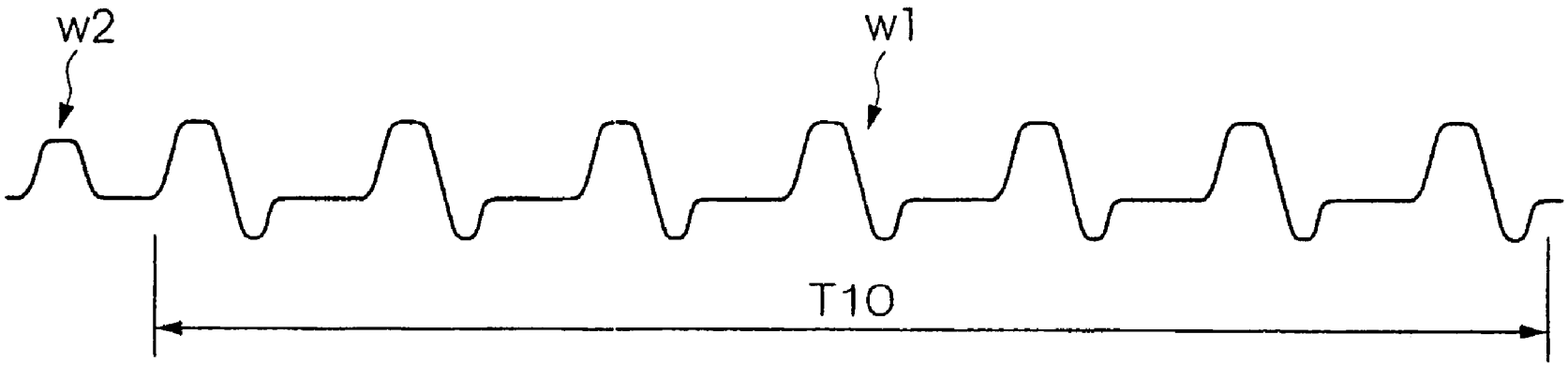

Although the preceding section has provided an explanation of the conversion of a trapezoidal drive waveform into a drive waveform that approximates a curved waveform, and a method for driving piezoelectric vibrator 20 with this drive waveform, the drive waveform is broadly divided into a discharge waveform for discharging liquid droplets, and a microvibration waveform for preventing nozzle hole clogging and unstable discharge as was previously mentioned. The method in which the drive waveform is in the form of a curved waveform as explained above is also used to make not only the discharge waveform, but also the microvibration waveform, curved waveforms. FIGS. 3A through 3C are drawings showing an example of a drive waveform and microvibration waveform that approximate curved waveforms, with FIG. 3A showing a discharge waveform that approximates a curved waveform, FIG. 3B showing a microvibration waveform that approximates a curved waveform, and FIG. 3C showing a composite drawing of a discharge waveform and microvibration waveform approximating a curved waveform.

As shown in FIG. 3A, discharge waveform w1 approximates a curved waveform overall when viewed macroscopically. In addition, as shown in FIG. 3B, microvibration waveform w2 also approximates a curved waveform when viewed macroscopically in the same manner as discharge waveform w1. In addition, in FIG. 3C, an example of a drive waveform is shown in which microvibration waveform w2 is applied to piezoelectric vibrator 20 prior to liquid droplet discharge time period T10, and discharge waveform w1 is only supplied to piezoelectric vibrator 20 during liquid droplet discharge time period T10. Furthermore, this does not mean that only the microvibration waveform prior to liquid droplet discharge time period T10 (pre-discharge microvibration waveform) is a waveform that approximates a curved waveform, but rather that the aforementioned constant microvibration waveform, mid-discharge microvibration waveform and post-discharge microvibration waveform also approximate a curved waveform when viewed macroscopically.

In this manner, according to the drive device of a liquid droplet discharge head according to the present embodiment, since the microvibration waveform is also in the form of a curved waveform, the mechanical load and its accompanying thermal load can be diminished in comparison with the case of driving by a trapezoidal square wave, thereby making it possible to inhibit deterioration of piezoelectric vibrator 20 and prolong its service life. In addition, in the present embodiment, the impedance when liquid droplet discharge head section 4 is viewed from drive waveform generation circuit 30 is larger by the amount of the FCC in which the trapezoidal drive waveform is converted to a drive waveform that approximates a curved waveform. Consequently, current supplied to piezoelectric vibrator 20 is smaller by the amount of the impedance of the FCC, thereby also making it possible to prolong the service life of piezoelectric vibrator 20.

(Application Examples)

Figure 4:
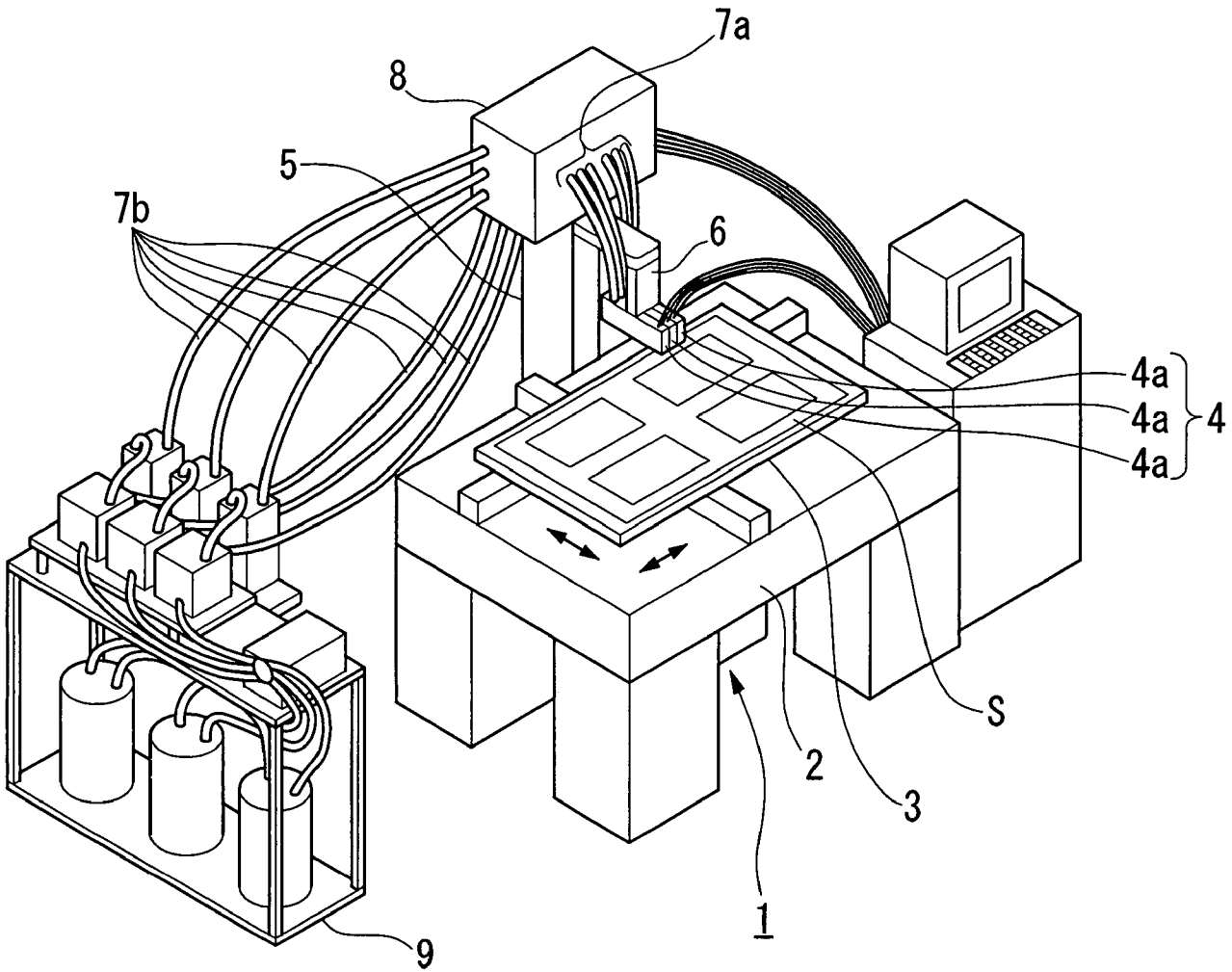
FIG. 4 is a schematic perspective view showing a summary of a film manufacturing apparatus of the present embodiment.

Next, an explanation is provided of a film manufacturing apparatus (liquid droplet discharge device) equipped with the drive device of a liquid droplet discharge head of the aforementioned embodiment with reference to FIG. 4. FIG. 4 is a schematic perspective view showing a summary of the film manufacturing apparatus of the present embodiment.

This film manufacturing apparatus 1 is used, for example, for the production of color filters, and is composed of an XY table 3 installed on a base frame 2 and capable of moving in the X and Y directions, and a liquid droplet discharge head 4 provided above this XY table 3.

An uncolored substrate S, on which is formed, for example, a black matrix, is installed on XY table 3. Liquid droplet discharge head 4 is attached to a support member 6 provided on frame 5, and has independent heads 4*a* for each color that discharge red, blue and green ink, respectively. Ink supply tubes 7 and electrical signal cables (such as FCC, not shown) are respectively and independently connected to each of these heads 4*a*.

An ink supply unit 9 is connected to the other ends of these ink supply tubes 7 through a valve box 8 that contains a three-way valve, dissolved oxygen meter and so forth.

On the basis of this constitution, this film manufacturing apparatus 1 is made to coat ink in a tank onto substrate S by discharging from liquid droplet discharge head section 4 through ink supply tubes 7*b*, valve box 8 and ink supply tubes 7*a* while moving liquid droplet discharge head section 4.

As shown in FIG. 1, for example, since film manufacturing apparatus 1 is equipped with liquid droplet discharge head section 4 that reduces the mechanical and thermal loads applied to piezoelectric vibrator 20, stable liquid droplets can be discharged over a long period of time.

In order to produce a color filter by discharging ink onto substrate S using film manufacturing apparatus 1 composed in this manner, substrate S is first installed at a predetermined position on XY table 3. Here, a transparent substrate having a suitable degree of mechanical strength and high optical transmittance is used for substrate S. Specific examples include a transparent glass substrate, acrylic glass, plastic substrate, plastic film and their surface treated products.

Figure 5:
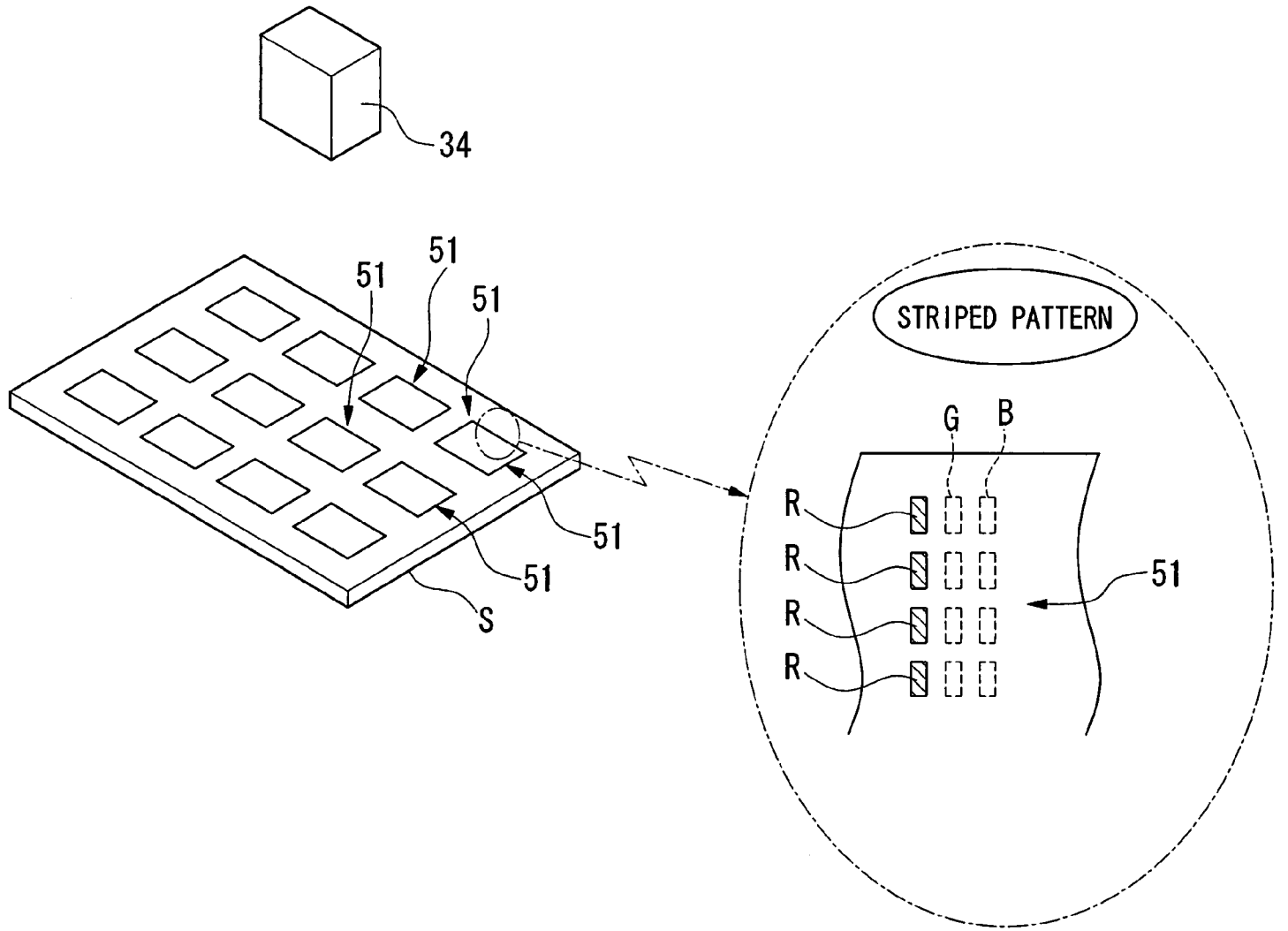
FIG. 5 is a drawing showing the color filter regions on a substrate.

In addition, in the present example, a plurality of color filter regions 51 are formed in the form of a matrix on a rectangular substrate S as shown in FIG. 5 from the viewpoint of increasing productivity. These color filter regions 51 can later be used as color filters suitable for a liquid crystal display device by cutting substrate S. Furthermore, as shown in FIG. 5, color filter regions 51 are arranged by respectively forming red (R), green (G) and blue (B) ink into predetermined patterns, and in this example, a striped pattern known in the prior art. Furthermore, other examples of formed patterns in addition to a striped pattern include mosaic, delta and square patterns.

Figure 6A:
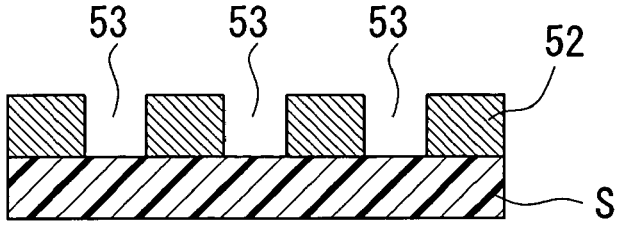
FIGS. 6A through 6F are cross-sectional views showing the essential portion of color filter regions for explaining the order of steps of a method of forming these color filter regions.

In order to form color filter patterns 51 in this manner, a black matrix 52 is first formed with respect to one side of transparent substrate S as shown in FIG. 6A. This black matrix 52 is formed by coating a non-light transmitting resin (preferably black) to a predetermined thickness (e.g., about 2 $\mu$m) by a method such as spin coating. The minimum display element, namely filter element 53, surrounded by the matrix of black matrix 52 has, for example, a width in the direction of the X axis of about 30 $\mu$m and a length in the direction of the Y axis of about 100 $\mu$m.

Figure 6B:
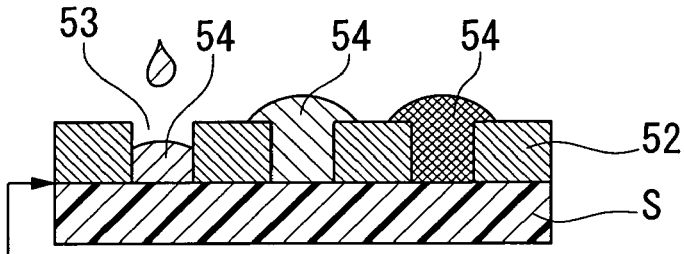

Next, as shown in FIG. 6B, ink droplets (liquid droplets) 54 are discharged from the aforementioned liquid droplet discharge head section 4 and impacted on filter element 53. The amount of discharged ink droplets 54 is an adequate amount in consideration of the reduction in ink volume in the heating step.

Figure 6C:
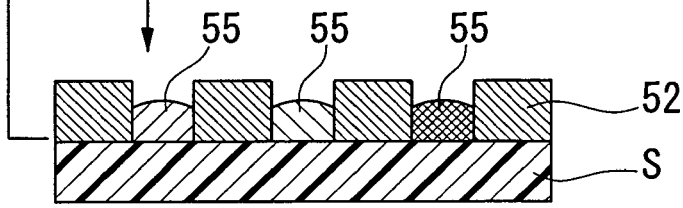

Once ink droplets 54 have been filled into all of the filter elements 53 on substrate S in this manner, substrate S is heat-treated to a predetermined temperature (e.g., about 70° C.) using a heater. As a result of this heat treatment, the ink solvent is evaporated and the ink volume decreases. In cases in which this decrease in volume is particularly large, the ink discharge step and heating step are repeated until an adequate ink film thickness is obtained for use as a color filter. As a result of this treatment, the solvent contained in the ink evaporates so that ultimately only the solid component contained in the ink remains in the form of a film, thereby resulting in color filters 55 as shown in FIG. 6C.

Figure 6D:
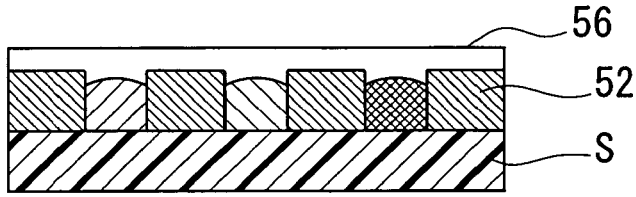

Next, in order to flatten substrate S and protect color filters 55, a protective film 56 is formed on substrate S so as to cover color filters 55 and black matrix 52 as shown in FIG. 6D. Although spin coating, roll coating or lipping and so forth can be used to form this protective film 56, the film manufacturing apparatus 1 shown in FIG. 4 can also be used in the same manner as in the case of color filters 55.

Figure 6E:
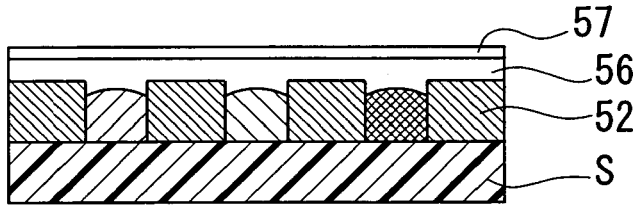
Figure 6F:
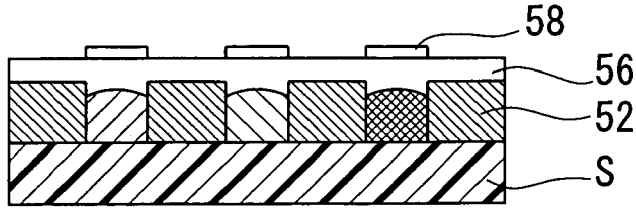

Next, as shown in FIG. 6E, transparent conductive film 57 is formed over the entire surface of protective film 56 by sputtering or vacuum vapor deposition and so forth. Subsequently, transparent conductive film 57 is patterned and pixel electrodes 58 are patterned corresponding to filter elements 53. Furthermore, this pattern is not required in the case of using thin film transistors (TFT) to drive the liquid crystal display panel.

In the production of color filters by this type of film manufacturing apparatus 1, since the color filters are produced using film manufacturing apparatus 1 capable of discharging stable liquid droplets over a long period of time, high-quality color filters can be produced inexpensively that are composed of a film in which film thickness, flatness, formed location and so forth are more precisely controlled than in the prior art.

Furthermore, the film manufacturing apparatus 1 of the present invention is not limited to the constitution shown in FIG. 4, and is not particularly required to be a constitution in which the constitution of liquid droplet discharge head section 4 is provided with three heads 4*a*.

Figure 7:
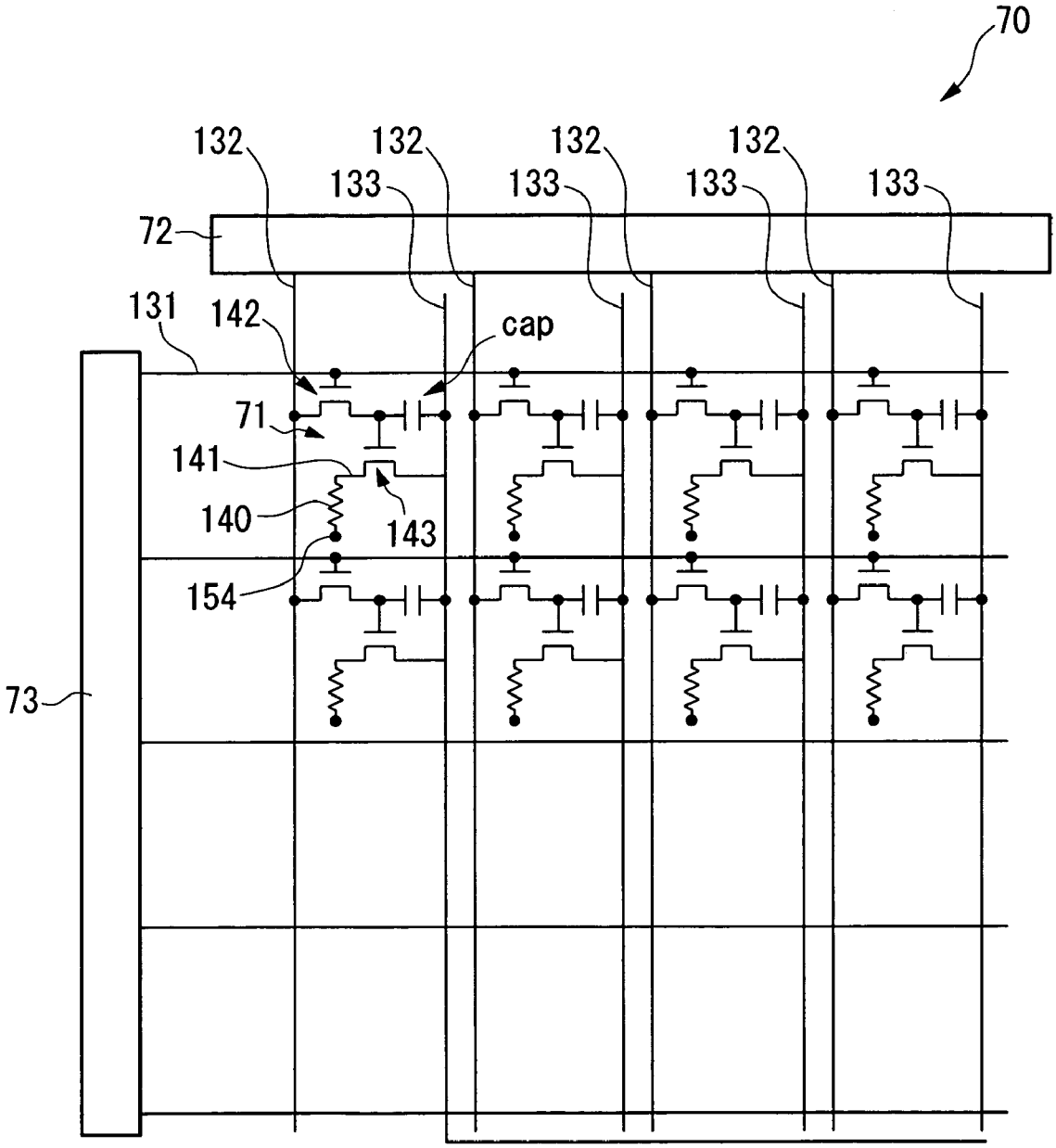
FIG. 7 is a circuit drawing of one example of an EL display equipped with organic EL elements.
Figure 8:
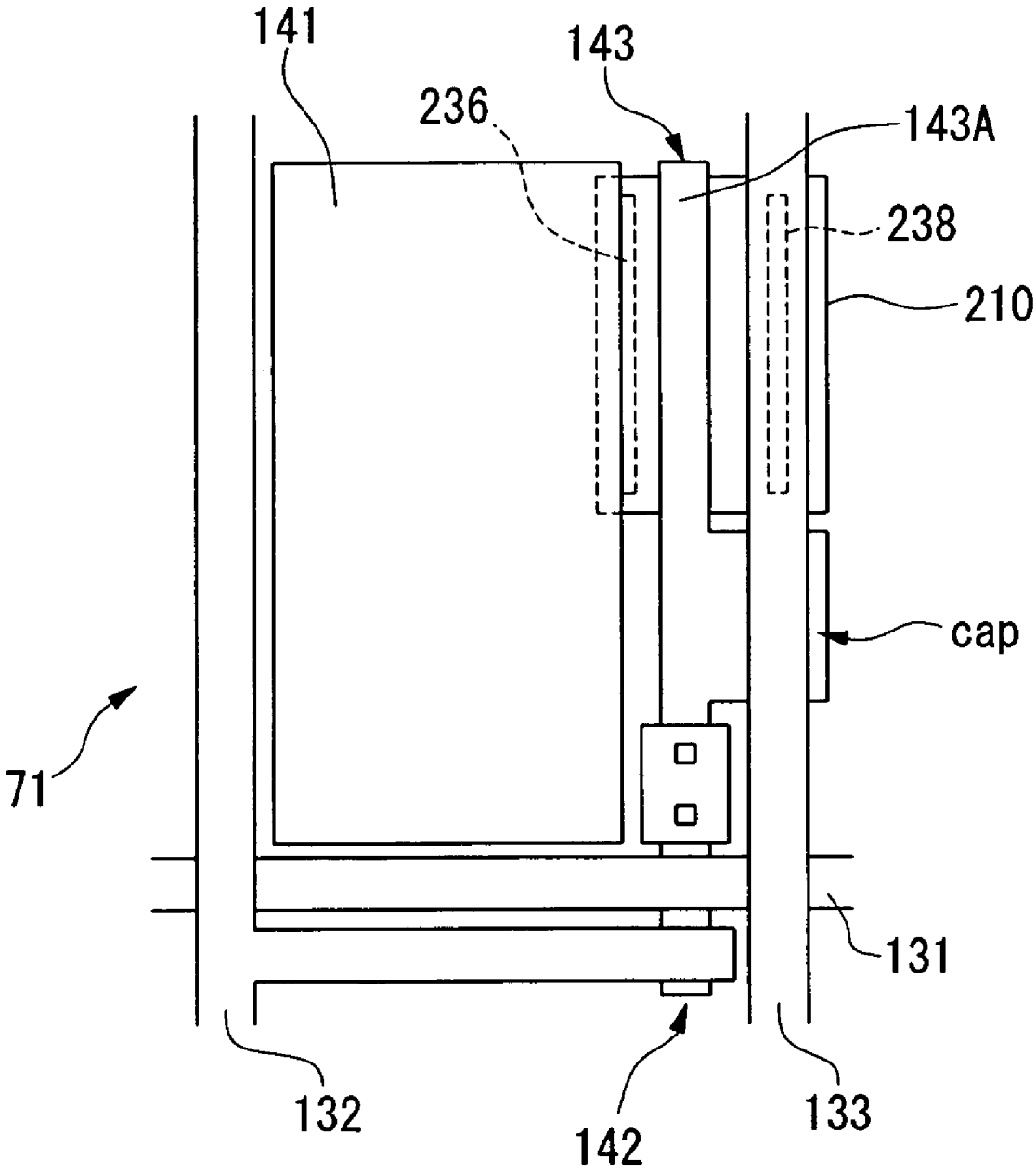
FIG. 8 is an enlarged overhead view showing the planar structure of the pixel section of the EL display shown in FIG. 7.

In addition, the aforementioned film manufacturing apparatus can also be used to form a thin film that serves as a constituent element of an organic EL element. FIGS. 7 and 8 are drawings for explaining the general constitution of an example of an EL display provided with such organic EL elements, and reference symbol 70 in these drawings represents an EL display.

This EL display 70 has a plurality of scanning lines 131, a plurality of signal lines 132 extending in a direction that intersects with these scanning lines 131, and a plurality of common power supply lines 133 extending in parallel with these signal lines 132, respectively wired on a transparent substrate as shown in the circuit drawing of FIG. 7, and pixels (pixel region elements) 71 are provided for each intersection of scanning lines 131 and signal lines 132.

A data side drive circuit 72 provided with a shift register, level shifter, video line and analog switch is provided for signal lines 132.

On the other hand, a scanning side drive circuit 73 provided with a shift register and level shifter is provided for scanning lines 131. In addition, a switching thin film transistor 142, in which a scanning signal is supplied to a gate electrode through a scanning line 131, a holding capacitor cap that holds the image signal supplied from a signal line 132 through switching thin film transistor 142, a current thin film transistor 143, in which an image signal held by holding capacitor cap is supplied to a gate electrode, a pixel electrode 141, into which drive current from a common power supply line 133 flows when electrically connected to a common power supply line 133 through current thin film transistor 143, and a light emitting section 140 interposed between pixel electrode 141 and a reflector electrode 154, are provided in each pixel region 71.

On the basis of this constitution, when a scanning line 131 is driven and switching thin film transistor 142 is switched on, the potential of signal line 132 at that time is held in holding capacitor cap, and the on/off status of current thin film transistor 143 is determined corresponding to the status of said holding capacitor cap. Current then flows from common power supply line 133 to pixel electrode 141 through the channel of current thin film transistor 143, after which it further flows to reflector electrode 154 through light emitting section 140. As a result, light emitting section 140 emits light corresponding to the amount of current that flows through it.

Here, as shown in FIG. 8 which is an enlarged overhead view with the reflector and organic EL element removed, the two-dimensional structure of each pixel 71 is arranged such that the four sides of pixel electrode 141 having a rectangular planar shape are surrounded by signal line 132, common power supply line 133, scanning line 131 and another pixel electrode scanning line not shown.

Next, an explanation of the production method of an organic EL element provided in such an EL display 70 is provided using FIGS. 9 through 11. Furthermore, only a single pixel 71 is shown in FIGS. 9 through 11 in order to simplify the explanation.

First, a substrate is made available. Here, in the organic EL element, a structure can also be used in which emitted light by an emission layer to be described later can be acquired from the substrate side or from the opposite side of the substrate. In the case of using a constitution in which emitted light is acquired from the substrate side, although a transparent or semi-transparent material such as glass, quartz or plastic is used for the substrate material, inexpensive glass is used particularly preferably.

In addition, the emitted color may be controlled by arranging a color converting film containing a color filter film or fluorescent substance, or a dielectric reflecting film, on the substrate.

In addition, in the case of using a constitution in which emitted light is acquired from the opposite side from the substrate, the substrate may be opaque, and in that case, an alumina or other ceramic sheet or a stainless steel or other metal sheet insulated with a surface oxide, a thermosetting resin or a thermoplastic resin and so forth can be used for the substrate.

Figure 9A:
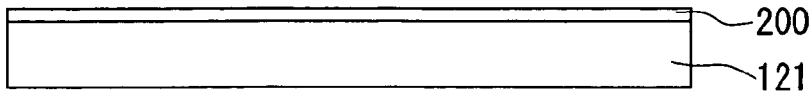
FIGS. 9A through 9E are cross-sectional views of the essential portion for explaining the order of steps of a method of producing organic EL elements.

In the present example, a transparent substrate 121 composed of glass and so forth is made available for the substrate as shown in FIG. 9A. An undercoating protective film (not shown) composed of a silicon oxide film having a thickness of about 200 nm to 500 nm is formed on this substrate by plasma CVD using as raw material tetraethoxysilane (TEOS) or oxygen gas as necessary.

Next, a semiconductor film 200 composed of an amorphous silicon film having a thickness of about 30 nm to 70 nm is formed by plasma CVD on the surface of the undercoating protective film by setting the temperature of transparent substrate 121 to about 350° C. Next, a crystallization step is performed on this semiconductor film 200 by laser annealing or the solid phase growth method and so forth to crystallize semiconductor film 200 on a polysilicon film. In the case of using laser annealing, annealing is performed with, for example, an excimer laser using a line beam having a beam length of 400 mm at an output intensity of, for example, 200 mJ/cm$^2$. The line beam is scanned so that the portion equivalent to 90% of peak value of beam intensity in the short direction overlaps each region.

Figure 9B:
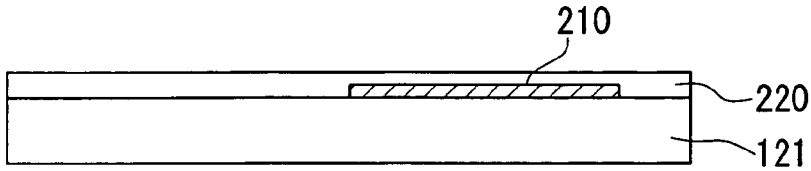

Next, as shown in FIG. 9B, semiconductor film (polysilicon film) 200 is patterned to form an island-shaped semiconductor film 210, and a gate insulating film 220 composed of a silicon oxide film or nitride film having a thickness of about 60 nm to 150 nm is formed on its surface by plasma CVD using TEOS or oxygen gas as raw material. Furthermore, although semiconductor film 210 serves as the channel region of current thin film transistor 143 shown in FIG. 8 as well as the source and drain regions, at the location of a different cross-section, a semiconductor film is also formed that serves as the channel region of switching thin film transistor 142 as well as the source and drain regions. In other words, in the production steps shown in FIGS. 9 through 11, although two types of transistors 142 and 143 are produced simultaneously, since they are produced by the same procedure, the following explanation of these transistors only pertains to current thin film transistor 143, while the explanation of switching thin film transistor 142 is omitted.

Figure 9C:
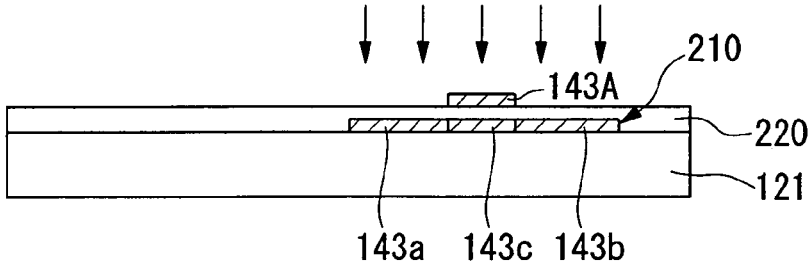

Next, as shown in FIG. 9C, after forming a conductive film composed of a metal film of aluminum, tantalum, molybdenum, titanium or tungsten and so forth by sputtering, this film is then patterned to form gate electrode 143A.

Next, source and drain regions 143*a* and 143*b* are formed while self-aligning with gate electrode 143A on semiconductor film 210 by injecting highly concentrated phosphorous ions while in this state. Furthermore, the section into which impurities are not introduced becomes channel region 143*c*.

Figure 9D:
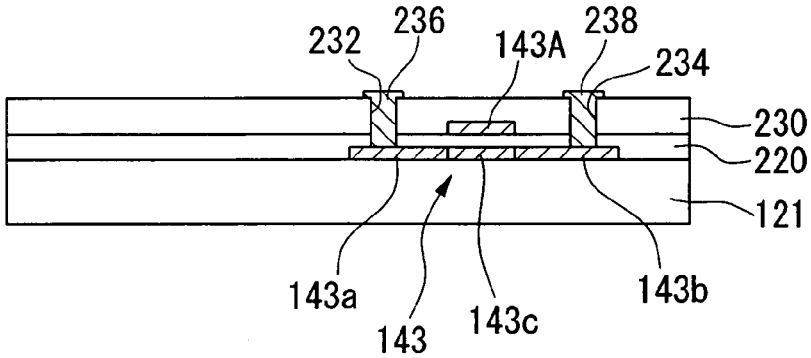

Next, as shown in FIG. 9D, after forming an interlayer insulating film 230, contact holes 232 and 234 are formed followed by embedding relay electrodes 236 and 238 within these contact holes 232 and 234.

Figure 9E:
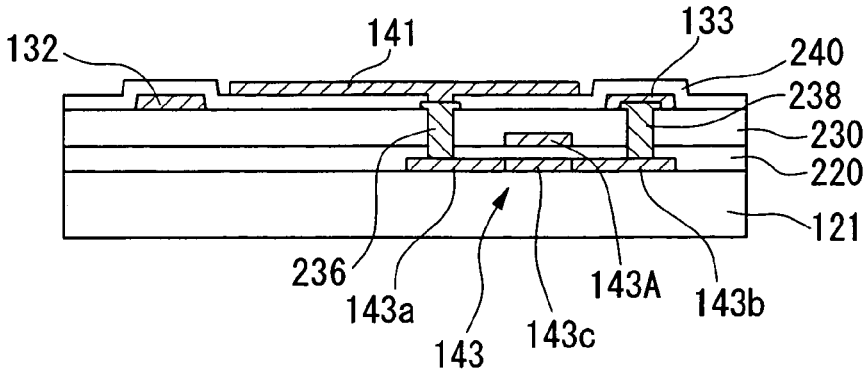

Next, as shown in FIG. 9E, signal line 132, common power supply line 133 and a scanning line (not shown in FIG. 9) are formed on interlayer insulating film 230. Here, relay electrode 238 and each of the wires may be formed in the same step. At this time, relay electrode 236 is formed by an ITO film to be described below.

An interlayer insulating film 240 is then formed so as to cover the upper surface of each wire, a contact hole (not shown) is formed at the position corresponding to relay electrode 236, an ITO film is formed so as to also be embedded within that contact hole, that ITO film is patterned, and a pixel electrode 141 electrically connected to source/drain region 143*a* is formed at a predetermined location surrounded by signal line 132, common power supply line 133 and a scanning line (not shown). Here, the section surrounded by signal line 132, common power supply line 133 and the scanning line (not shown) serves as the formed location of a positive hole injection layer and light emitting layer to be described below.

Figure 10A:
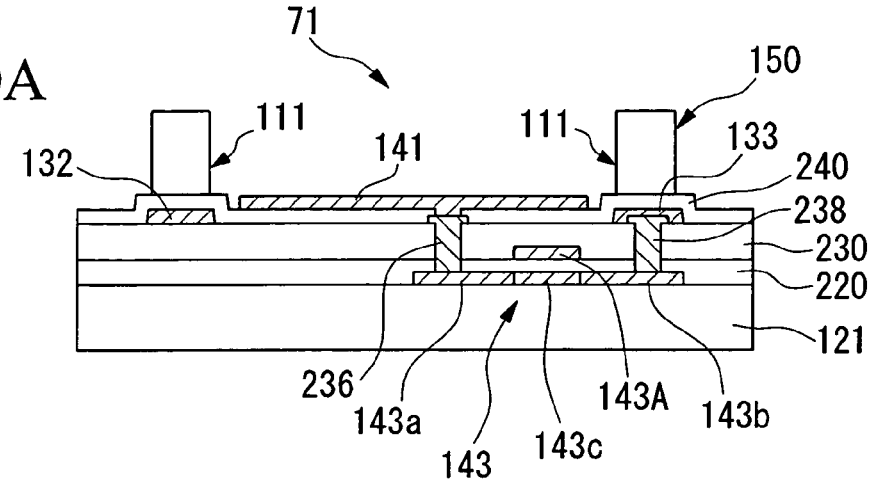
FIGS. 10A through 10C are cross-sectional views of the essential portion for explaining the order of steps continuing from FIG. 9.

Next, as shown in FIG. 10A, a partition 150 is formed so as to surround the aforementioned formed location. This partition 150 functions as a separating material, and is preferably formed with, for example, polyimide or other insulating organic material. The film thickness of partition 150 is formed so have a height of, for example, 1 $\mu$m to 2 $\mu$m. In addition, partition 150 also preferably exhibits non-affinity for liquid discharged from liquid droplet discharge head section 4. A method, for example, in which the surface of partition 150 is treated with a fluorine-based compound and so forth is employed to allow partition 150 to express non-affinity. Examples of fluorine-based compounds include $CF_4$, $SF_5$ and $CHF_3$, and examples of surface treatment include plasma treatment and UV irradiation treatment.

On the basis of this constitution, a step 111 of sufficient height is formed at the formed location of the positive hole injection layer and light emitting layer, namely between the coating location of their forming materials and partition 150 that surrounds it.

Figure 10B:
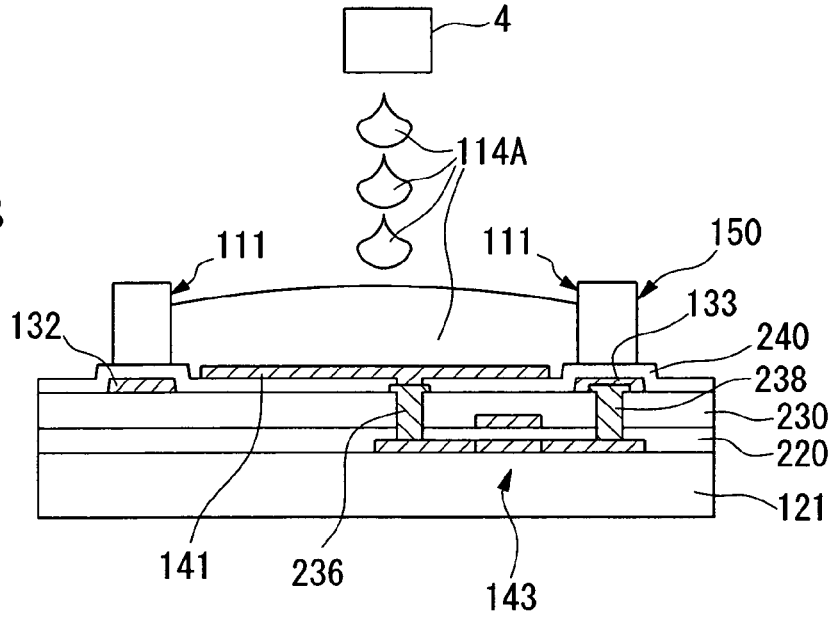

Next, as shown in FIG. 10B, a liquid forming material 114A is selectively coated onto the coating location surrounded by the aforementioned partition 150, namely inside partition 150, by discharging the forming material of the positive hole injection layer from the aforementioned liquid droplet discharge head section 4 with the upper surface of substrate 121 facing upward.

Examples of forming materials of the positive hole injection layer include polyphenylenevinylene, 1,1-bis-(4-N,N-ditriaminophenyl) cyclohexane, tris(8-hydroxyquinolinol), aluminum, and so on in which the polymer precursor is polytetrahydrothiophenylphenylene.

At this time, although liquid forming material 114A attempts to spread out in the horizontal direction due to its high fluidity, since partition 150 is formed surrounding the coated location, forming material 114A is prevented from spreading to the outside by overflowing partition 150.

Figure 10C:
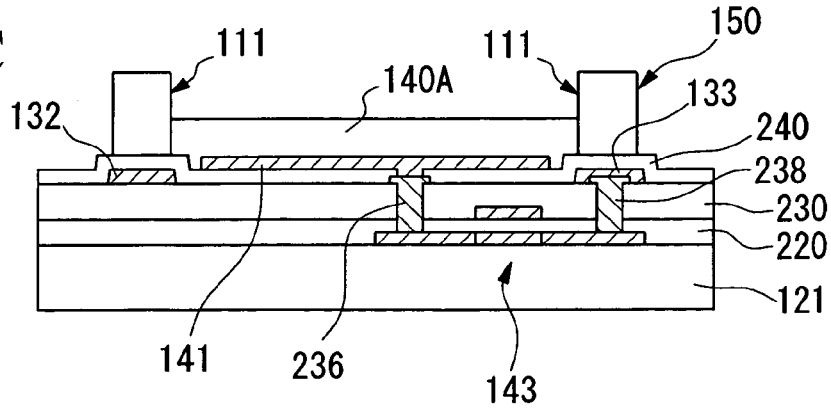

Next, as shown in FIG. 10C, the solvent of liquid precursor 114A is evaporated by heating or light irradiation to form a solid positive hole injection layer 140A on pixel electrode 141.

Figure 11A:
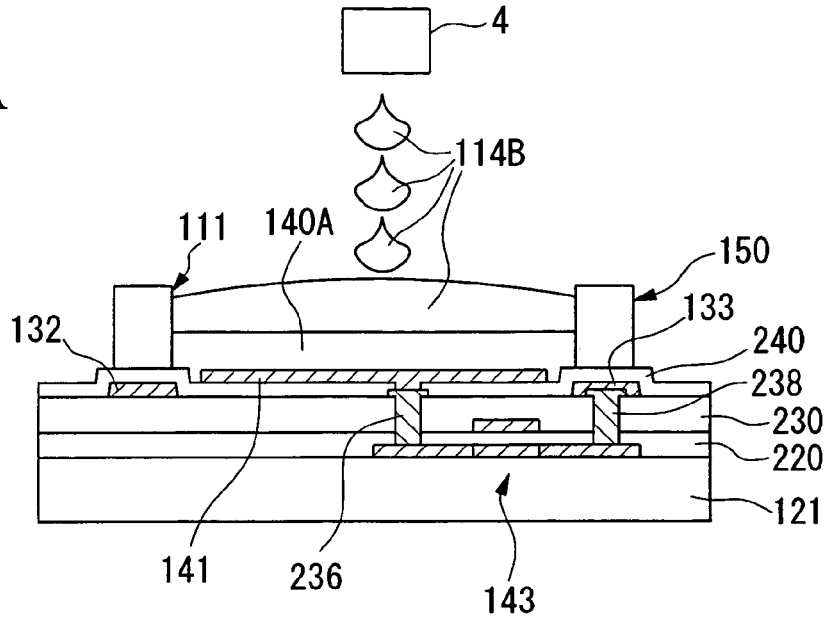
FIGS. 11A through 11C are cross-sectional views of the essential portion for explaining the order of steps continuing from FIG. 10.

Next, as shown in FIG. 11A, a forming material of the light emitting layer (light emitting material) 114B is selectively coated onto positive hole injection layer 140A within the aforementioned partition 150 in the form of an ink from liquid droplet discharge head section 4 with the upper surface of substrate 121 facing upward.

A material that contains, for example, a precursor of a conjugated polymer organic compound and a fluorescent pigment for changing the emission characteristics of the resulting light emitting layer, is preferably used for the forming material of the light emitting layer.

The precursor of a conjugated polymer organic compound refers to that which allows the formation of a light emitting layer to serve as a conjugated polymer organic EL layer by being discharged from liquid droplet discharge head section 4 together with fluorescent pigment to form a thin film followed by heating and curing, and in the case the precursor is a sulfonium salt, for example, the sulfonium group is eliminated by heat treatment to obtain a conjugated polymer organic compound.

This type of conjugated polymer organic compound has intense fluorescence in solid form and is capable of forming a homogeneous solid ultra-thin film. Moreover, it is rich in forming ability and exhibits a high degree of adhesion with an ITO electrode. Moreover, since a precursor of such a compound forms a rigid conjugated polymer film following curing, a precursor solution prior to heating and curing can be adjusted to a desired viscosity applicable to ink jet patterning to be described later, thereby enabling film formation under optimum conditions to be carried out easily and in a short period of time.

Preferable examples of such precursors include precursors of PPV (poly(para-phenylenevinylene) and its derivatives. Precursors of PPV or its derivatives are soluble in water or organic solvent, and since they can be polymerized, are capable of allowing the obtaining of optically high-quality thin films. Moreover, since PPV has intense fluorescence, and is also a conductive polymer in which the $\pi$ electrons of the double bonds are non-localized on the polymer chain, it allows the obtaining of high-performance organic EL elements.

Examples of precursors of PPV or PPV derivatives include PPV (poly(para-phenylenevinylene)) precursors, MO-PPV (poly(2,5-dimethoxy-1,4-phenylenevinylene)) precursors, CN-PPV (poly(2,5-bishexyloxy-1,4-phenylene- (1-cyanovinylene))) precursors, and MEH-PPV (poly[2-methoxy-5-(2'-ethylhexyloxy)]-para-phenylenevinylene) precursors.

PPV or PPV precursors are soluble in water as was previously mentioned, and form a PPV layer by polymerizing by heating after film manufacturing. The content of precursor represented by the aforementioned PPV precursors is preferably 0.01 wt % to 10.0 wt %, and more preferably 0.1 wt % to 5.0 wt %, relative to the overall composition. If the added amount of precursor is too low, it is inadequate for forming a conjugated polymer film, while if added in excess, the viscosity of the composition increases and may become unsuitable for high-precision patterning by the ink jet method.

Moreover, at least one type of fluorescent pigment is preferably contained in the forming material of the light emitting layer. As a result, the emission characteristics of the light emitting layer can be changed, making this effective as a way to, for example, improve the emission efficiency of the light emitting layer or change the maximum wavelength of optical absorption (emitted color). Namely, the fluorescent pigment can be used not only simply as a light emitting layer material, but also as a pigment material that is responsible for the emission function itself. For example, nearly all of the energy of excitons generated in carrier re-bonding on conjugated polymer organic compound molecules can be transferred to the fluorescent pigment molecules. In this case, since emission only occurs from fluorescent pigment molecules having a high fluorescent quantum efficiency, the current quantum efficiency of the light emitting layer also increases. Thus, as a result of adding fluorescent pigment to the forming material of the light emitting layer, since the emission spectrum of the light emitting layer simultaneously becomes that of the fluorescent molecules, it is effective as a way to change the emitted color.

Furthermore, the current quantum efficiency referred to here is a scale for discussing emission performance based on emission function, and is defined as indicated below.

$$\eta E = \text{Released photon energy/input electrical energy}$$

The three primary colors of red, blue and green light, for example, can be emitted by converting the maximum wavelength of optical absorption by doping with fluorescent pigment, thereby making it possible to obtain a full color display.

Moreover, the emission efficiency of an EL element can also be significantly improved by doping with fluorescent pigment.

In the case of forming a light emitting layer that emits red light, rhodamine or a rhodamine derivative that emits red light is preferably used for the fluorescent pigment. Since these fluorescent pigments have low molecular weights, they are soluble in water, exhibit favorable compatibility with PPV and allow a uniform and stable light emitting layer to be formed easily. Specific examples of these fluorescent pigments include rhodamine B, rhodamine B base, rhodamine 6G and rhodamine 101 perchlorate, and a mixture of two or more of these may also be used.

In addition, in the case of forming a light emitting layer that emits green light, quinacridone and its derivatives that emit green light are used preferably. Similar to the aforementioned red fluorescent pigment, since these fluorescent pigments have a low molecular weight, they are soluble in water, exhibit favorable compatibility with PPV, and allow a light emitting layer to be formed easily.

Moreover, in the case of forming a light emitting layer that emits blue light, distyrylbiphenyl and its derivatives are used preferably. Similar to the aforementioned red fluorescent pigment, since these fluorescent pigments have a low molecular weight, they are soluble in mixed solutions of water and alcohol, exhibit favorable compatibility with PPV, and allow a light emitting layer to be formed easily.

In addition, other examples of fluorescent pigments that emit blue light include coumarin and its derivatives. Similar to the aforementioned red fluorescent pigment, since these fluorescent pigments have a low molecular weight, they are soluble in aqueous solutions, exhibit favorable compatibility with PPV and allow a light emitting layer to be formed easily. Specific examples of such fluorescent pigments include coumarin, coumarin-1, coumarin-6, coumarin-7, coumarin 120, coumarin 138, coumarin 152, coumarin 153, coumarin 311, coumarin 314, coumarin 334, coumarin 337, coumarin 343, and so on.

Moreover, other examples of fluorescent pigments that emit blue light include tetraphenylbutadiene (TPB) and TBP derivatives. Similar to the aforementioned red fluorescent pigment, since these fluorescent pigments have a low molecular weight, they are soluble in aqueous solutions, exhibit favorable compatibility with PPV, and allow a light emitting layer to be formed easily.

Only one type of the fluorescent pigments described above may be used for each color, or two or more types may be mixed.

These fluorescent pigments are preferably added at 0.5 wt % to 10 wt %, and more preferably at 1.0 wt % to 5.0 wt %, to the precursor solid component of the aforementioned conjugated polymer organic compound. If the amount of fluorescent pigment added is too large, it becomes difficult to maintain the weather resistance and durability of the light emitting layer, while if the amount added is too low, the effect of adding the fluorescent pigment as previously described cannot be adequately obtained.

In addition, the aforementioned precursor and fluorescent pigment are preferably dissolved or dispersed in a polar solvent to form an ink, after which this ink is preferably discharged from liquid droplet discharge head section 4. Since a polar solvent is able to easily dissolve or uniformly disperse the aforementioned precursors and fluorescent pigments, the occurrence of adherence or clogging by the solid component of the light emitting layer forming material in the nozzle hole of liquid droplet discharge head section 4 can be prevented.

Specific examples of such polar solvents include water, alcohols that are compatible with water, such as methanol and ethanol, organic solvents such as N,N-dimethylformamide (DMF), N-methylpyrolidone (NMP), dimethylimidazoline (DMI) and dimethylsulfoxide (DMSO), inorganic solvents and suitable mixtures of two or more types of these solvents.

Moreover, a lubricant is preferably added to the aforementioned forming material. As a result, drying and coagulation of the forming material in the nozzle hole of liquid droplet discharge head section 4 can be effectively prevented. Examples of such lubricants include polyvalent alcohols such as glycerin and diethylene glycol, and two or more types of these may be mixed. The amount of lubricant added is preferably about 5 wt % to 20 wt % relative to the total amount of forming material.

Furthermore, other additives and film stabilizing materials may also be added, examples of which include stabilizers, viscosity adjusters, aging preventives, pH adjusters, antiseptics, resin emulsions and leveling agents.

When such a light emitting layer forming material 114B is discharged from the nozzle hole of liquid droplet discharge head section 4, forming material 114A is coated onto positive hole injection layer 140A within partition 150.

Here, the formation of a light emitting layer by discharge of forming material 114A is carried out by discharging and coating the forming material of a light emitting layer that emits red light, the forming material of a light emitting layer that emits green light, and the forming material of light emitting layer that emits blue light onto a pixel 71 corresponding to each color. Furthermore, pixel 71 corresponding to each color is predetermined so as to be arranged in a systematic manner.

Figure 11B:
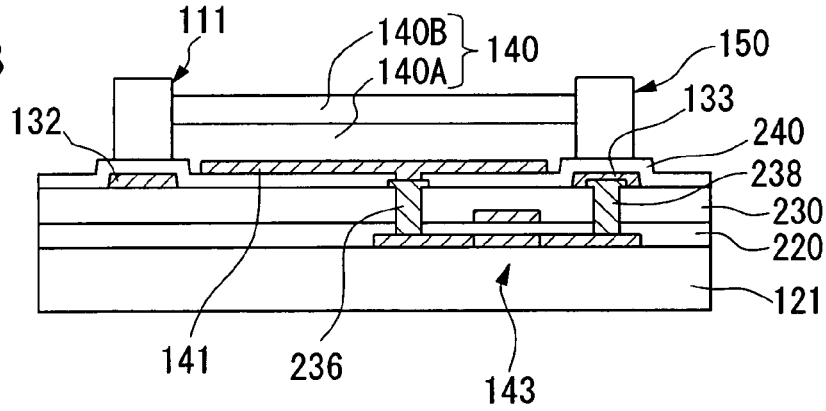

Once each color of light emitting layer forming material has been discharged and coated in this manner, by evaporating the solvent contained in light emitting layer forming material 114B, a solid light emitting layer 114B is formed on positive hole injection layer 140A as shown in FIG. 11B, and as a result, light emitting section 140 is obtained composed of positive hole injection layer 140A and light emitting layer 140B. Here, although the evaporation of the solvent in light emitting layer forming material 114B is carried out by treatment such as heating or pressure reduction as necessary, since the light emitting layer forming material normally has satisfactory drying properties and dries rapidly, each color of light emitting layer 140B can be formed in the order of coating by sequentially discharging and coating each color of light emitting layer forming material without necessarily performing this treatment.

Figure 11C:
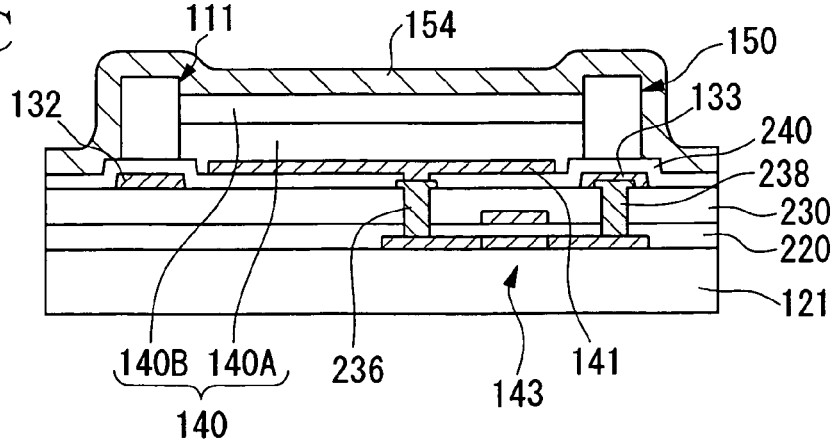

Subsequently, as shown in FIG. 11C, reflector electrode 154 is formed over the entire surface or in the form of stripes on transparent substrate 121 to obtain an organic EL element.

Even in the production method of an organic EL element in this manner, since the thin films serving as constituent elements of the organic EL element in the form of positive hole injection layer 140A and light emitting layer 140B can be produced by film manufacturing apparatus 1, the film thickness, flatness, formed location and so forth of positive hole injection layer 140A and light emitting layer 140B can be precisely controlled, thereby making it possible to reduce the probability of the occurrence of defects and enabling stable organic EL elements to be formed comparatively inexpensively.

(Electronic Equipment)

The following provides an explanation of an example of electrical equipment equipped with a device that is an optical element of the aforementioned embodiments (color filter or organic EL element).

Figure 12:
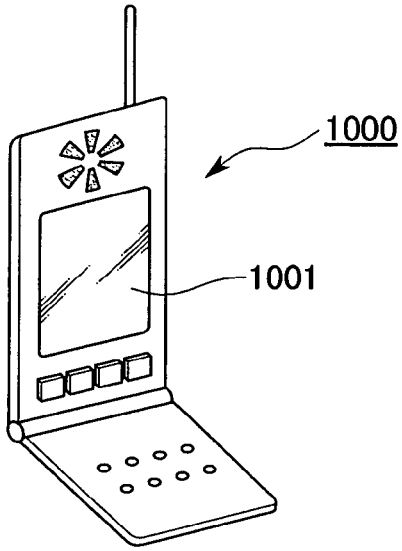
FIG. 12 is a drawing showing an example of electronic equipment equipped with an optical element of the present embodiment.

FIG. 12 is a perspective view showing an example of a cellular telephone. In FIG. 12, reference symbol 1000 indicates a cellular telephone body, while reference symbol 1001 indicates a display section that uses the aforementioned optical element.

Figure 13:
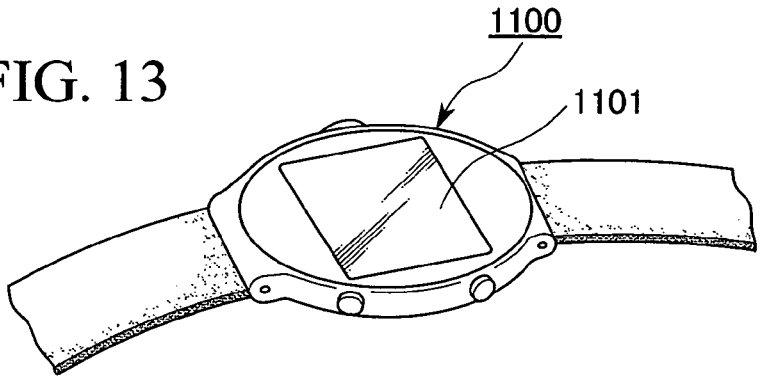
FIG. 13 is a drawing showing another example of electronic equipment equipped with an optical element of the present embodiment.

FIG. 13 is a perspective view of an example of a wristwatch-type electronic device. In FIG. 13, reference symbol 1100 indicates a wristwatch body, while reference symbol 1101 indicates a display section that uses the aforementioned color filter.

Figure 14:
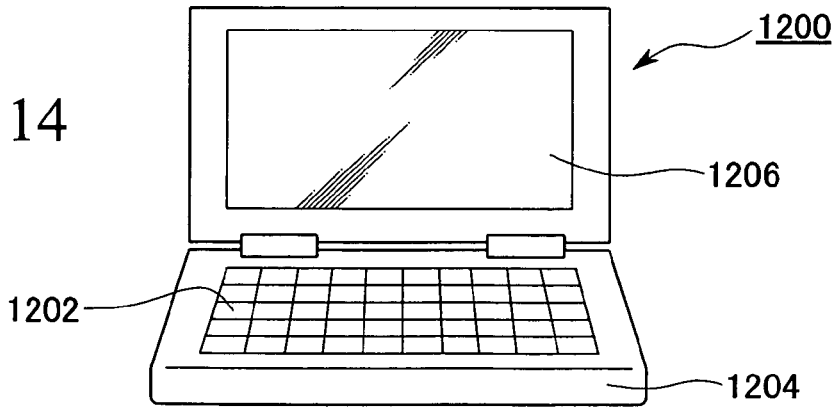
FIG. 14 is a drawing showing another example of electronic equipment equipped with an optical element of the present embodiment.
Figure 15:
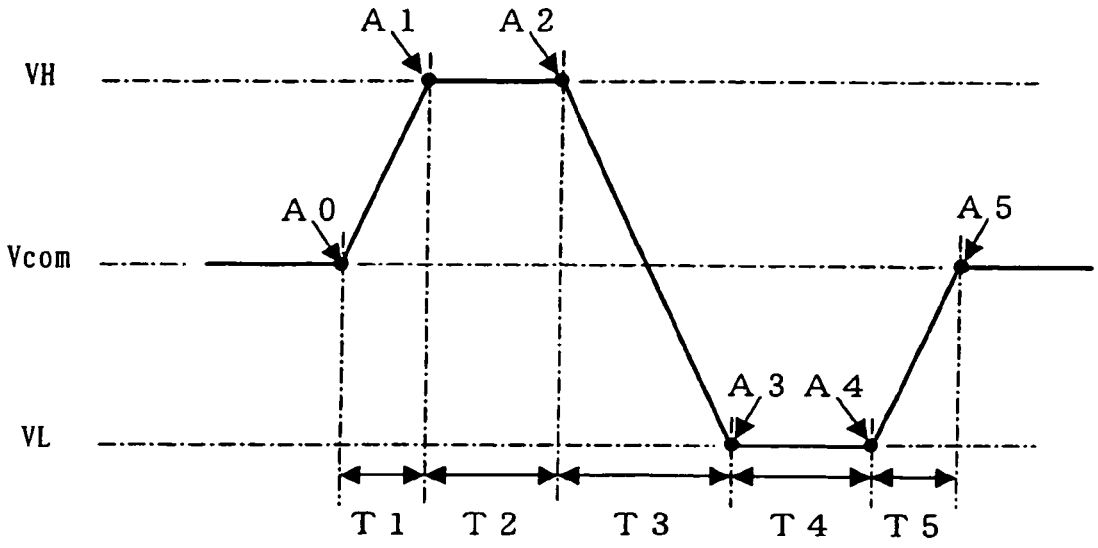
FIG. 15 PRIOR ART
FIG. 15 is a drawing showing a drive waveform of a piezoelectric vibrator according to a square wave of the prior art.

FIG. 14 is a perspective view showing an example of a portable information processing device such as a word processor or personal computer. In FIG. 14, reference symbol 1200 indicates an information processing device, reference symbol 1202 indicates an input section such as a keyboard, reference symbol 1204 indicates an information processing device body, and reference symbol 1206 indicates a display section that uses the aforementioned color filter.

Since the electronic equipment shown in FIGS. 12 through 14 are equipped with the optical elements of the aforementioned embodiments, they are capable of satisfactorily displaying images and allow production costs to be reduced while also making it possible to shorten production time.

Furthermore, the present invention is not limited to the aforementioned embodiments, but rather can naturally be altered in various ways within a range that does not deviate from the gist of the present invention. For example, a resistor R may be used instead of inductor L. In this case, a low-pass RC filter is composed, and the drive waveform applied to piezoelectric vibrator 20 becomes an integrated waveform as shown in (c) of FIG. 2. Although the same level of effectiveness cannot be expected as in the case of inductor L since the waveform is not completely free of transition points (transition points A0, A2 and A4 remain), a fixed effect is obtained. In addition, a constitution may also be employed that uses both inductor L and resistor R.

In addition, a parasitic inductance component and resistance component such as an FFC or analog switch connected between drive control circuit 10 and drive waveform generation circuit 30 can also be used for inductor L and resistor R.

In addition, a film composed of metal wiring may also be deposited by discharging a liquid containing fine metal particles onto a desired surface from the drive device of a liquid droplet discharge head of the aforementioned embodiments. As a result of discharging in this manner, since a stable film can be deposited that is able to serve as metal wiring for a long period of time, metal wiring composed of a film in which film thickness, flatness, formed location and so forth are more precisely controlled than in the prior art, namely metal wiring having a low probability of disconnection and which can be arranged at high density, can be produced inexpensively.

Furthermore, devices produced by applying the present invention are not limited to the aforementioned embodiments, but rather the present invention can be applied over a wide range to production by performing a predetermined deposited film treatment using a functional liquid. An example of such production in addition to those previously mentioned is the application of the present invention to the production of a microlens array.

What is claimed is:

1. A drive device of a liquid droplet discharge head comprising a piezoelectric vibrator which discharges liquid droplets from a discharge section by applying a predetermined drive waveform to said piezoelectric vibrator, wherein a drive control unit is provided that drives said piezoelectric vibrator according to said drive waveform composed of a curved shape, and said drive waveform is free of sharp edges.

2. A drive device of a liquid droplet discharge head according to claim 1, wherein said drive waveform is generated by being converted from a rectangular or trapezoidal square wave by a waveform conversion unit.

3. A drive device of a liquid droplet discharge head according to claim 1, wherein said drive waveform contains a discharge waveform for discharging said liquid droplets, and a microvibration waveform that minutely vibrates said piezoelectric vibrator to a degree that it does not discharge said liquid droplets.

4. A film manufacturing apparatus provided with a drive device of a liquid droplet discharge head according to claim 1 that performs film manufacturing treatment at a predetermined location on a treated object by discharging a functional liquid from said liquid droplet discharge head.

5. A film manufacturing apparatus according to claim 4, wherein said film manufacturing apparatus is a device that produces a color filter.

6. A film manufacturing apparatus according to claim 4, wherein said film manufacturing apparatus is a device that forms a film having for its constituent element an organic electroluminescence element.

7. A film manufacturing apparatus according to claim 4, wherein, said film manufacturing apparatus is a device that discharges a liquid containing metallic fine particles from said liquid droplet discharge head, and which forms a film to serve as metal wiring by discharging said liquid onto a desired surface.

8. A drive method of a liquid droplet discharge head comprising discharging of liquid droplets from a discharge section by extending and retracting a piezoelectric vibrator according to a predetermined drive waveform, wherein said method has a process of driving said piezoelectric vibrator according to said drive waveform composed of a curved waveform, and said drive waveform is free of sharp edges.

9. A drive method of a liquid droplet discharge head according to claim 8, wherein said drive waveform is generated based on a rectangular or trapezoidal square wave.

10. A drive method of a liquid droplet discharge head according to claim 8, wherein said drive waveform contains a discharge waveform for discharging said liquid droplets, and a microvibration waveform that minutely vibrates said piezoelectric vibrator to a degree that it does not discharge said liquid droplets.

11. A film manufacturing method that forms a film using the drive method of a liquid droplet discharge head according to claim 8.

12. A film manufacturing method according to claim 11, wherein, said film manufacturing method is used when forming a film to serve as a constituent element of a color filter.

13. A film manufacturing method according to claim 11, wherein, said film manufacturing method is used when forming a film serving as constituent element of an organic electroluminescence element.

14. A film manufacturing method according to claim 11, wherein, said film manufacturing method forms a film to serve as metal wiring by discharging a liquid containing metallic fine particles from said liquid droplet discharge head onto a desired surface.

15. A device production method for producing a device by coating a functional liquid at a predetermined location on a substrate, wherein a step is contained in which the functional liquid is discharged at a predetermined location of said substrate from said liquid droplet discharge head using a drive method of a liquid droplet discharge head according to claim 8.

* * * * *